US005727465A

United States Patent [19]

Kelm et al.

[11] Patent Number: 5,727,465

[45] Date of Patent: Mar. 17, 1998

[54] SIDE WALL OF A PRINTING UNIT IN A SHEET-FED ROTARY PRINTING PRESS

[75] Inventors: Carsten Kelm, Mannheim; Oliver Koch, Heidelberg; Norbert Thünker, Hirschberg; Michael Voge, Malsch, all of Germany

[73] Assignee: Heidelberger Druckmaschinen AG, Heidelberg, Germany

[21] Appl. No.: 758,377

[22] Filed: Nov. 27, 1996

[30] Foreign Application Priority Data

Nov. 29, 1995 [DE] Germany ..... 195 44 477.9

[51] Int. Cl.[6] ..... B41F 5/00

[52] U.S. Cl. ..... 101/216; 101/141; 101/153; 101/212

[58] Field of Search ..... 101/212, 216, 101/130, 141, 146, 150, 153, 158, 163, 173, 174, 193; 248/639

[56] References Cited

U.S. PATENT DOCUMENTS

| | | | |
|---|---|---|---|
| 2,310,262 | 2/1943 | Shields | 101/216 |
| 2,948,215 | 8/1960 | Tyma, Jr. et al. | 101/216 |
| 4,137,843 | 2/1979 | Ottenhue | 101/153 |
| 4,793,584 | 12/1988 | Etchell | 248/639 |
| 5,048,418 | 9/1991 | Hars et al. | 101/178 |

FOREIGN PATENT DOCUMENTS

| | | |
|---|---|---|
| 1 237 140 | 3/1967 | Germany . |
| 26 52 141 | 8/1977 | Germany . |
| 86 20 168.9 | 10/1986 | Germany . |
| 606939 | 8/1948 | United Kingdom . |

*Primary Examiner*—Christopher A. Bennett

*Attorney, Agent, or Firm*—Herbert L. Lerner; Laurence A. Greenberg

[57] ABSTRACT

A side wall of a printing unit of a sheet-fed rotary printing press is composed of a plurality of in-line printing units in accordance with unit construction principles. The side wall has a torsionally rigid side-wall body formed with a boxlike cross-sectional profile open on one side thereof and has a frame extending somewhat transversely to a plane wherein the side wall is disposed. The frame is formed with at least one recess through which gear wheels of a gear-wheel drive train are at least engageable or possess a kinking and back-springing course, respectively, between an upper structural region and a lower structural region of the side wall, including a removable lid ribbed on an inner side thereof and being disposed on the frame in the lower structural region wherein bearings for printing cylinders are received and at an open side of the boxlike cross-sectional profile for stiffening the frame. The frame is formed with recesses in the lower structural region thereof.

9 Claims, 5 Drawing Sheets

5
5b
11
11
5a
5
7
7
6
5
12
12
11
5c
11

SIDE WALL OF A PRINTING UNIT IN A SHEET-FED ROTARY PRINTING PRESS

BACKGROUND OF THE INVENTION

FIELD OF THE INVENTION

The invention relates to a side wall of a printing unit of a sheet-fed rotary printing press composed of a plurality of in-line printing units in accordance with unit construction principles, the side wall having a torsionally rigid side-wall body formed with a boxlike cross-sectional profile open on one side thereof and having a frame extending somewhat transversely to a plane wherein the side wall is disposed; the frame being formed with at least one recess through which gear wheels of a gear-wheel drive train are at least engageable or possess a bending-off and back-springing course, respectively, between an upper structural region and a lower structural region of the side wall.

In the side wall of the printing-unit frame, considerable forces are effective during operation. The attainable print quality is dependent to a great extent upon the rigidity of the side wall construction. Side wall developments with measures for increasing torsional rigidity are found in the prior art produced by various manufacturers. In a development which has become known by the designation "KBA Rapida 104" from the printing press made by the firm König & Bauer-Albert, the side wall of a printing unit frame, on the drive side, is constructed in modular fashion, with a lower module and having an upper module disposed thereon. The lower module, which extends over a plurality of printing units, is stiffened on the outside of the printing press by a frame which is joined integrally to a flat, approximately vertically extending part. Together, the two modules form a box which receives the gear wheels of the drive wheel train and is closed on the outside by sheet-metal guards and is partly filled with oil. In the region of a printing unit, at least one gear wheel extends through an opening formed in an upper member of the frame in order to be able to engage or mesh with the teeth of a gear wheel which transmits a driving force from the drive wheel train to driven cylinders and rollers of the printing unit with the inking unit. These cylinders and rollers, however, are supported in a separate upper module, which is disposed on and screwed to the lower module. This two-part embodiment has a deleterious effect upon the stability of the printing unit. Moreover, the lower module extending over many printing units is a hindrance to flexibly assembling individual printing units together to meet specific customer needs.

SUMMARY OF THE INVENTION

It is accordingly an object of the invention to provide a side wall of a printing unit of a sheet-fed rotary printing press composed of a plurality of printing units in an in-line formation, wherein the side wall is as stiff or rigid as possible.

With the foregoing and other objects in view, there is provided, in accordance with the invention, a side wall of a printing unit of a sheet-fed rotary printing press composed of a plurality of in-line printing units in accordance with unit construction principles, the side wall having a torsionally rigid side-wall body formed with a boxlike cross-sectional profile open on one side thereof and having a frame extending somewhat transversely to a plane wherein the side wall is disposed, the frame being formed with at least one recess through which gear wheels of a gear-wheel drive train are at least engageable or possess a kinking and back-springing course, respectively, between an upper structural region and a lower structural region of the side wall, comprising a removable lid ribbed on an inner side thereof and being disposed on the frame in the lower structural region wherein bearings for printing cylinders are received and at an open side of the boxlike cross-sectional profile for stiffening the frame, the frame being formed with recesses in the lower structural region thereof.

In accordance with another feature of the invention, the lid is screwed to the frame.

In accordance with a further feature of the invention, the lid and the frame engage with one another in a form-locking manner. In this regard, it is noted that a form-locking connection is a connection between two elements which results from the shape of the elements themselves, as opposed to a force-locking connection, the elements are locked together by force external to the elements.

In accordance with an added feature of the invention, the frame between the upper structural region and the lower structural region of the side wall has the respective kinking and back-springing course, and the side wall includes members selected from the group thereof consisting of supports, ribs and struts connecting a kinking portion of the frame to a bottom portion of the frame, the members being additionally built into the box profile for increasing rigidity of the side wall.

In accordance with an additional feature of the invention, the side wall body is of one-piece construction, and the side wall includes a removable plate mounted in the upper structural region, wherein bearings for rollers of an inking unit and bearings for cylinders of a printing unit are received, for stiffening the side wall body on the open side of the boxlike cross-sectional profile, the removable plate serving to transmit axial forces of the roller bearings to the side wall body.

In accordance with yet another feature of the invention, the lid is formed of steel or cast iron.

In accordance with yet a further feature of the invention, the recesses are open at the side for facilitating assembly of the gear wheels.

In accordance with yet an added feature of the invention, the frame of the side wall of a respective printing unit is constructed integrally with respect to the upper structural region of the side wall wherein bearings of the rollers of an inking unit are received, and with respect to the lower structural region of the side wall wherein bearings of printing unit cylinders are received.

In accordance with a concomitant feature of the invention, the supports extend at both sides around bearings of shafts connecting the gear wheels and the printing cylinders.

According to the invention, at least on the drive side, the side wall printing unit is formed with a boxlike cross-sectional profile, open on one side, which is fixedly joined, in particular, screwed, to the frame of the side wall body with the aid of a flexurally rigid and torsionally rigid lid, ribbed on the inside, preferably of steel or cast iron.

In addition to the stable lid construction, it is also possible, in accordance with a more-extensive concept of the invention, for supports to be built into the frame of the side wall body, as well, for the purpose of additionally stiffening the side wall body.

The one-piece side wall body which receives bearings for rollers of the inking unit and for cylinders of the printing unit in the upper region of the side wall, may also be stiffened on the open side of a boxlike cross-sectional profile, in the upper structural region, by a plate that transmits axial forces of the bearings to the side wall body. Such a plate transmits the axial forces, which preferably originate from distributor rollers, directly onto the frame of the boxlike one-piece side wall, thus advantageously utilizing the high resistance moment to bending and tension of a box wall. Moreover, this plate can be used as an additional bearing location for the inking unit rollers.

Other features which are considered as characteristic for the invention are set forth in the appended claims.

Although the invention is illustrated and described herein as embodied in a side wall of a printing unit in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
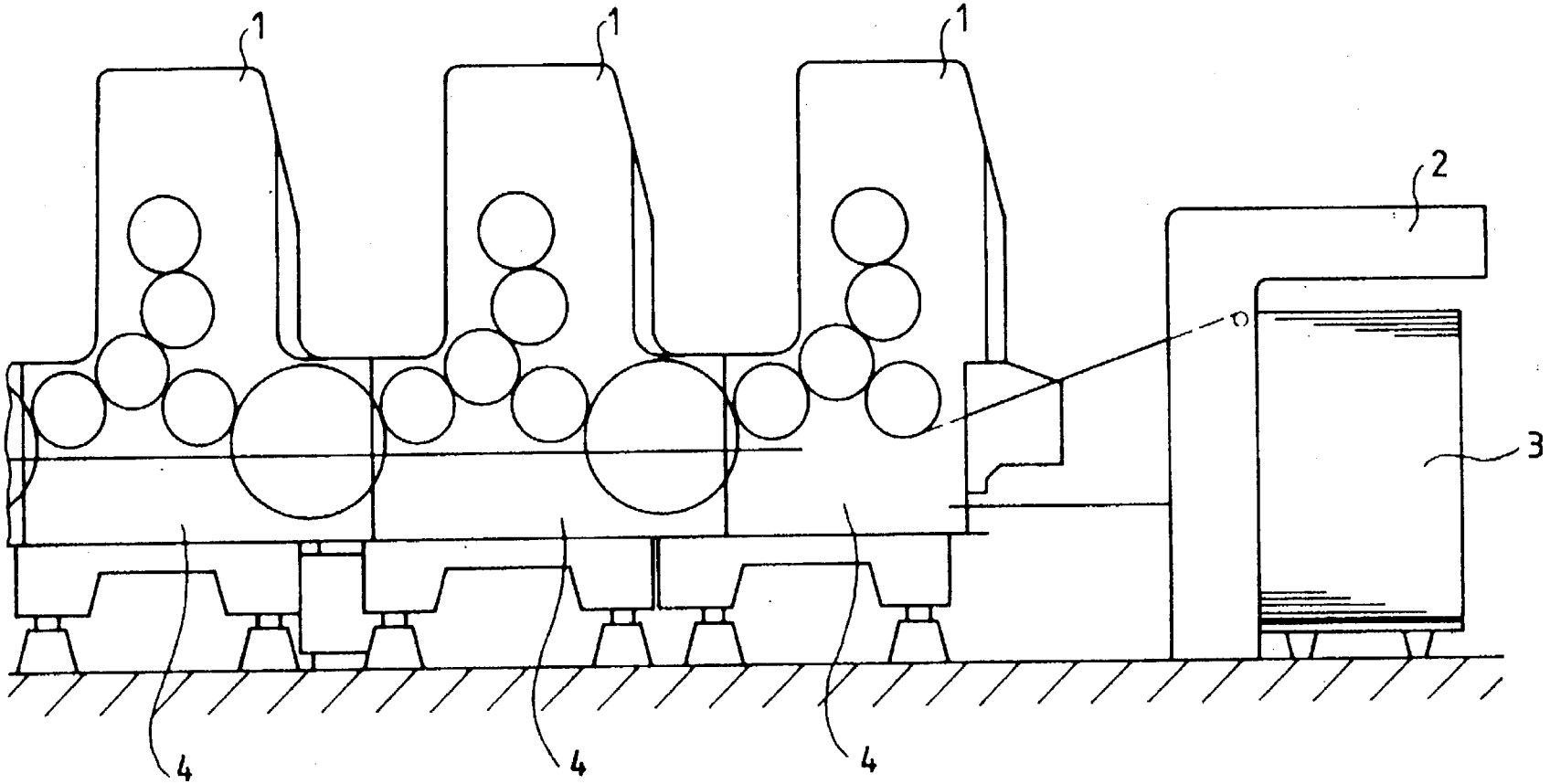
FIG. 1 is a side elevational view of a sheet-fed rotary printing press having a plurality of printing units arranged in-line and in accordance with unitary construction principles.

Referring now to the drawings and, first, particularly to FIG. 1 thereof, there is shown therein a sheet-fed rotary printing press in accordance with the unitary construction principle, wherein a plurality of printing units are disposed in-line and a feeder 2 is provided, which individually separates sheets of paper made ready in a sheet pile 3, and delivers them to the first printing unit 1. Each printing unit has a side wall 4 on each of the two sides of the printing press, i.e., the drive and the control or operating sides thereof, bearings for sheet-guiding cylinders, inking rollers, or the like being disposed in the side walls 4. The side walls 4 of the printing units 1 are of integral construction, i.e., in one piece, on both sides of the printing press and are joined to one another in a conventional manner. Each one-piece side wall 4 is formed with a lower structural region **4*a* and an upper structural region 4*b*. The bearings for sheet-guiding cylinders are disposed in the lower structural region 4*a*, and the bearings for the gear wheels of the drive wheel train are disposed on the drive side. The bearings of the plate cylinder, the rubber blanket cylinder and the rollers of the inking unit are located in the upper structural region 4*b*. At least on the drive side, the side-wall body is of boxlike form, so that it has an essentially flat vertical wall and a frame 5 integrally joined thereto and extending approximately at perpendicularly thereto, both the vertical wall and the frame 5 together forming a shell-like structure, which is open toward the outer side of the printing press. In the region of the gearwheels 6 of the drive wheel train, recesses 7 (FIGS. 2 and 5 to 7), which are open at the sides, are provided, through which the individual gearwheels 6 extend. These recesses 7 may be open toward the outside in order to facilitate the assembly and disassembly of the gearwheels 6**.

Figure 2:
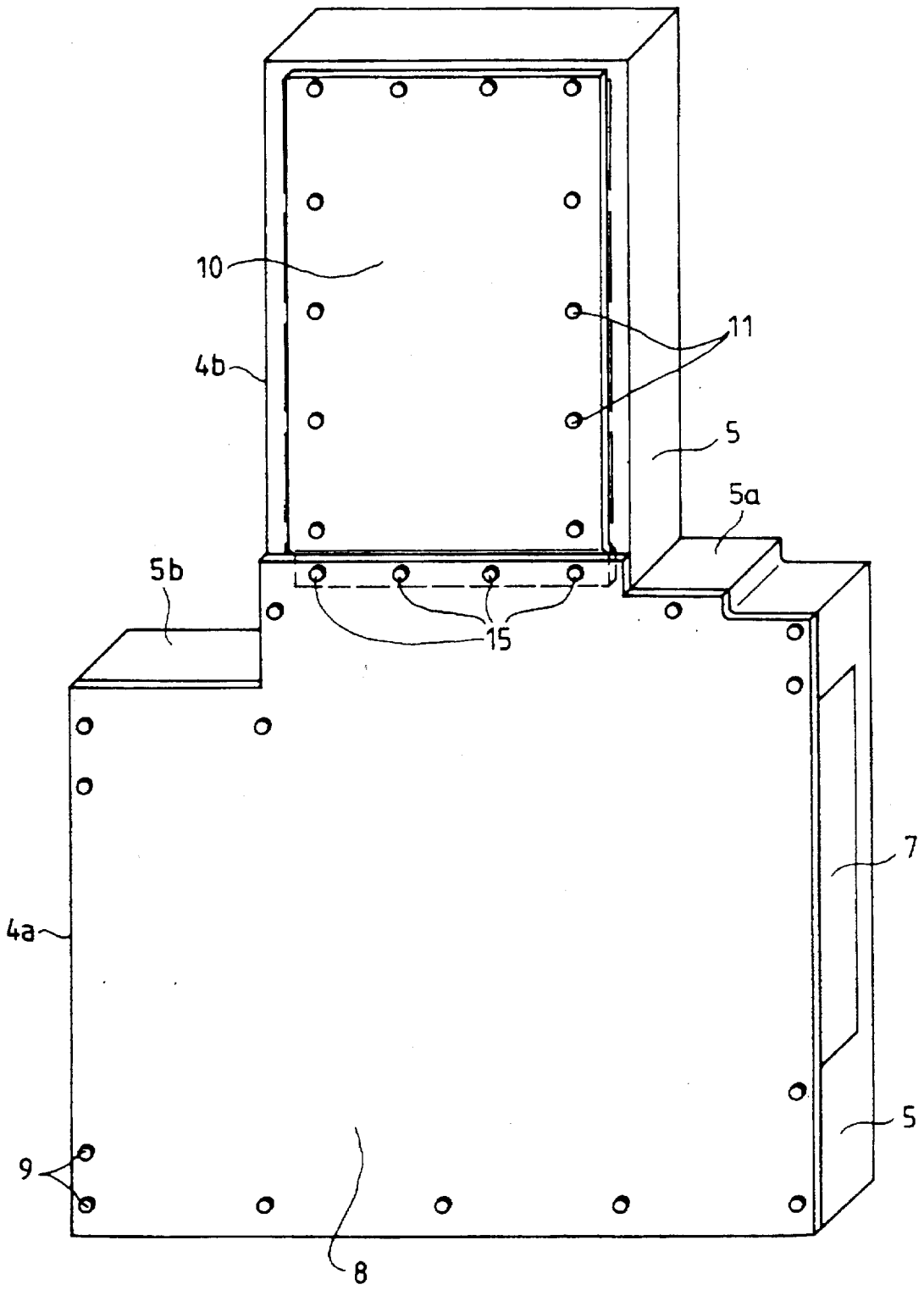
FIG. 2 is a basic perspective representation of a boxlike side wall with a lid or cover in a lower and upper structural region in accordance with the invention.
Figure 3:
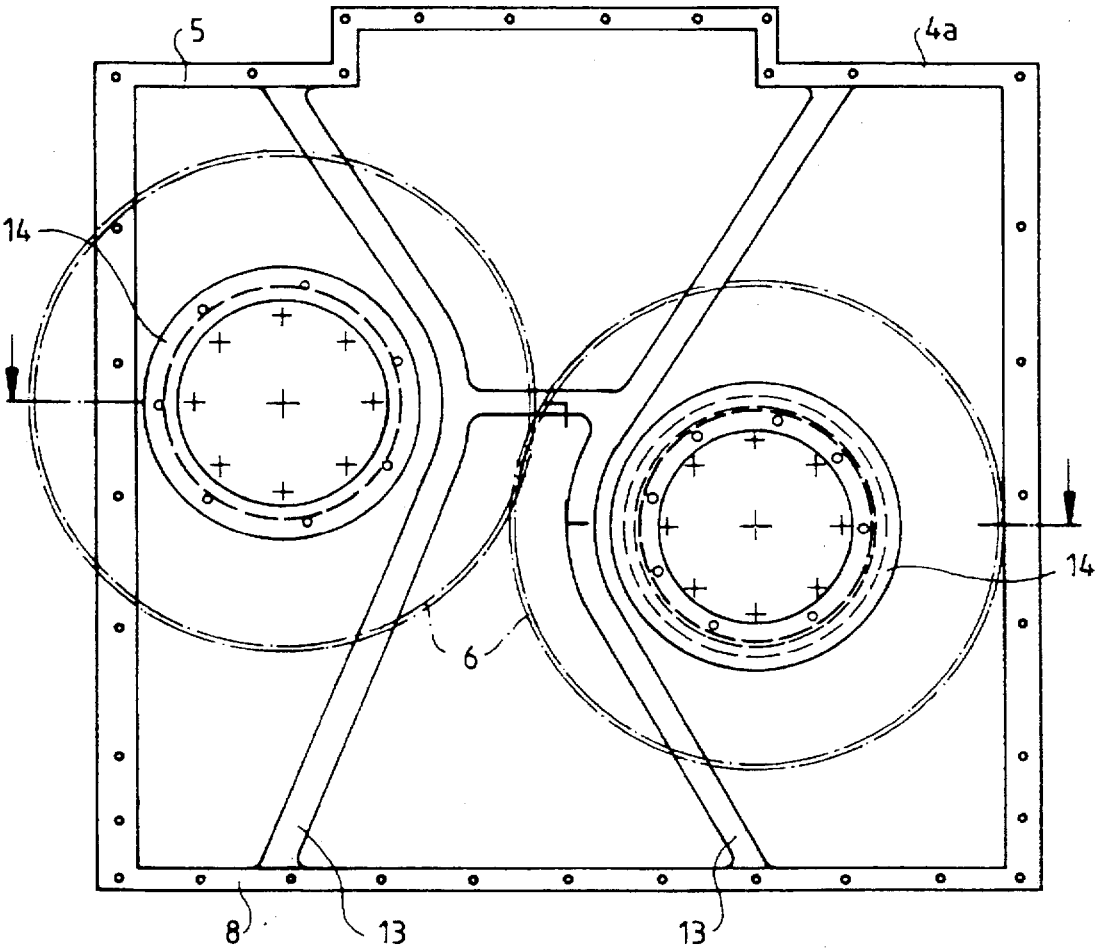
FIG. 3, a side elevational view with an exemplary embodiment for a stiffened lid.
Figure 4:
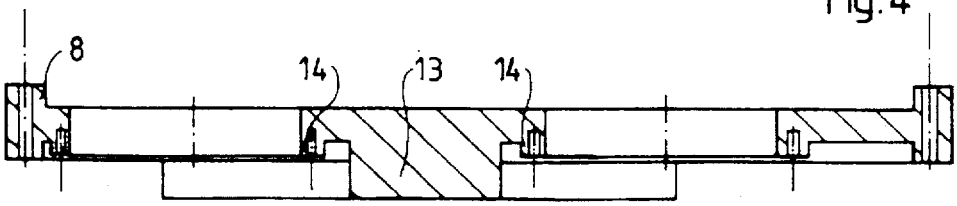
FIG. 4 is a horizontal sectional view of FIG. 3 taken along the line IV—IV in the direction of the arrows.

As shown in FIG. 2, a stiff or rigid lid 8, which is ribbed on the inside, is placed onto the open side of this shell-like box construction and fixedly joined to the end faces of the frame 5 by screws 9 or the like. Part of the circumference of the gearwheels 6 of each printing unit extends through the respective lateral recesses 7 formed in the frame 5 of the side wall and thereby enable the meshing of the teeth of the gearwheels 6 of the gearwheel train between adjacent printing units, the side walls of which are placed quite close together in the printing press and are likewise joined to one another. The lid or cover 8, which is made as torsionally rigid as possible, preferably is of steel construction, or is formed of a cast or molded part and of a stiff composite construction, respectively. An exemplary embodiment for the lid 8 is shown in FIGS. 3 and 4, wherein high flexural and torsional rigidity of the lid 8 is attained by ribs 13 and 14.

As shown in FIG. 2, in the upper structural region **4*b*, a stiff plate 10 is provided fixedly joined to the side wall body by screws 11. The plate 10 stiffens the box construction of the side wall in the upper structural region 4*b* and transmits axial forces of the friction rollers directly to the frame 5 of the box construction of the side wall. The high resistance moment of flexion and torsion of a box construction is accordingly advantageously utilized. The stiff plate 10 is easily removable and thus has advantages in terms of maintenance and repair work at the inking unit. Moreover, the stiff plate can serve as an additional bearing location for the inking unit rollers. Although, it has been known heretofore to provide additional bearing locations for the inking rollers in a side wall, in the inking unit region, through the use of a plate, nevertheless, such a plate is secured with stay bolts, which makes the fastening considerably softer than in the construction according to the invention. An optional reinforcement is achieved by additionally joining the plate 10 to the lid 8 in a form- or force-locking fashion, for example, by a screw connection 15 which is indicated in broken lines in FIG. 2**. In this regard, it is again noted that a form-locking connection is one which connects two elements together due to the shape of the elements themselves, as opposed to a force-locking connection, which locks the elements together by force external to the elements. Thus, a force-locking connection is one which connects two elements together by force external to the elements, as opposed to a form-locking connection which is provided by the shapes of the elements themselves.

Figure 5:
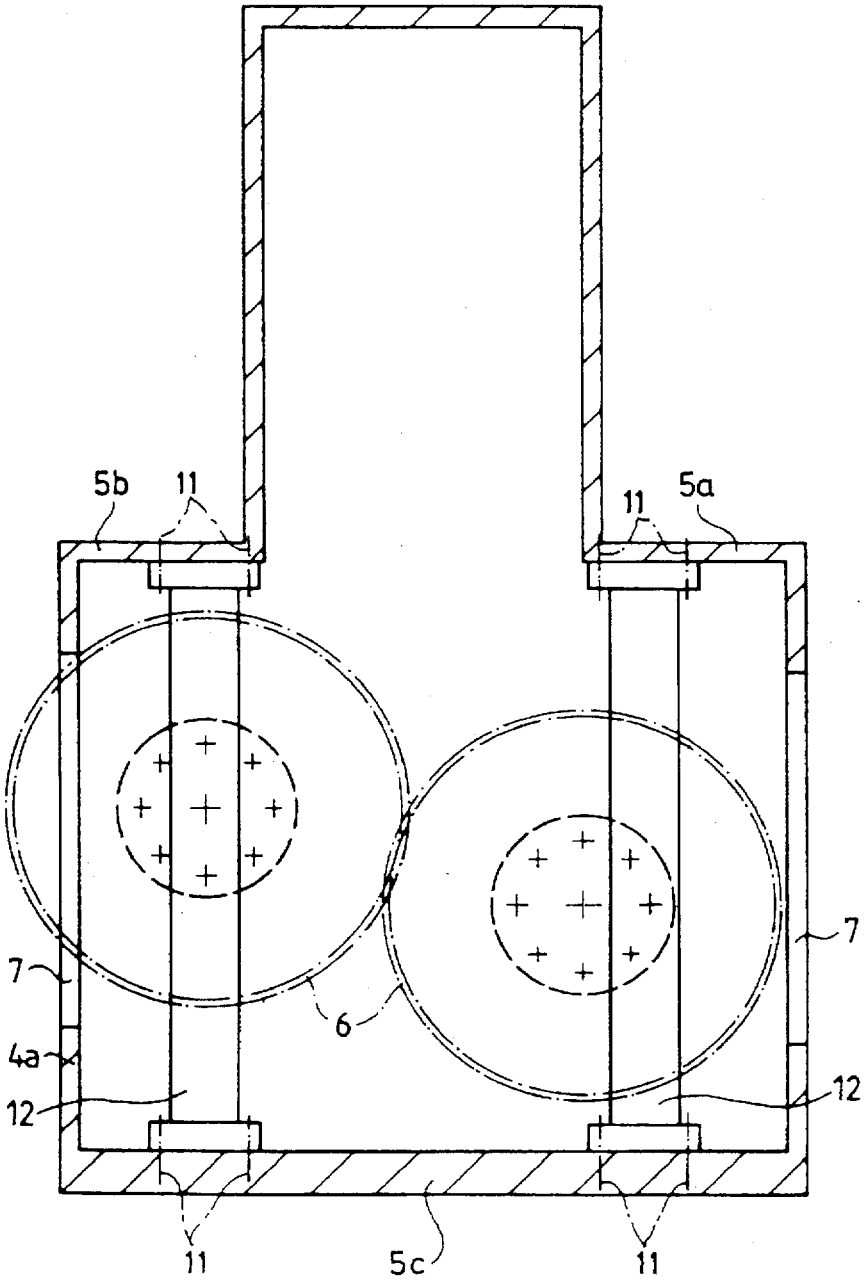
FIG. 5 is a vertical sectional view of another embodiment of the side wall of FIG. 2, the side wall being provided with stiffening supports.
Figure 6:
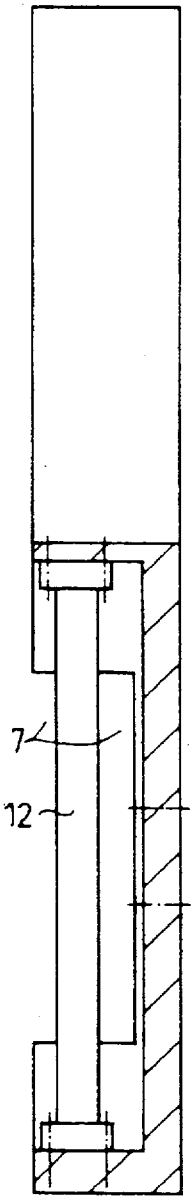
FIG. 6 is a side elevational view, partly in cross section, of FIG. 5.
Figure 7:
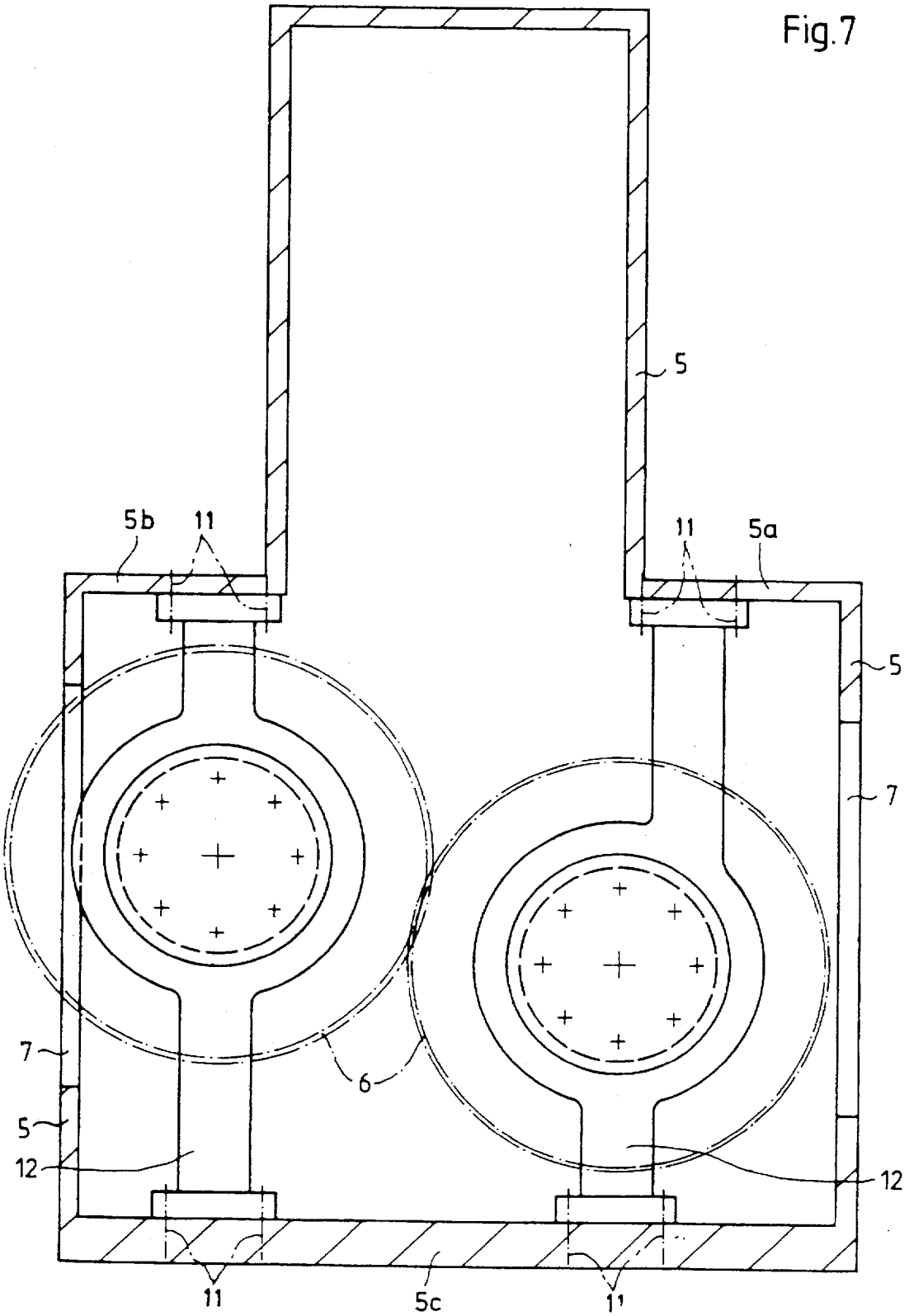
FIG. 7 is a vertical sectional view of a modified exemplary embodiment of the side wall.

Instead of the support achieved by the torsionally rigid lid 8, or as a supplement thereto, in the exemplary embodiment of FIGS. 5 to 7, additional supports 12 for additionally reinforcing the box construction of the side wall body are mounted inside the frame of the box construction, at least in the lower structural region **4*a* thereof. The ends of the supports 12 are advantageously connected by screws 11 to the frame parts 5 of the box construction, to allow easy assembly and disassembly of the supports 12. Instead of straight supports 12 as in the example of FIGS. 5 and 6, such supports 12 may also be formed with recesses in the region of the gearwheels 6, as shown in FIG. 7. This has the advantage over the constructions of FIGS. 5 and 6 that the gearwheel adjustments can be accomplished easily without having to disassemble the supports 12** to do so.

Since the greater forces occur on the drive side, the features of the invention have been described hereinbefore in terms of the side wall on the drive side. With a view to the lowest possible costs for production and inventory maintenance, it is desirable and feasible for the side walls to be of identical construction both for the drive side and for the control or operating side.

We claim:

1. A side wall of a printing unit of a sheet-fed rotary printing press composed of a plurality of in-line printing units in accordance with unit construction principles, the side wall comprising:

a torsionally rigid side-wall body having an upper structural region, a lower structural region, a boxlike cross-sectional profile formed with an opening on one side thereof and a frame extending somewhat transversely to a plane wherein the side wall is disposed;

said frame being formed with at least one recess in said lower structural region through which gear wheels of a gear-wheel drive train are at least engageable and a kinked portion formed between said upper structural region and said lower structural region of said side wall body;

a removable lid ribbed on an inner side thereof and disposed on said frame in said lower structural region wherein bearings for printing cylinders are received and at said one side of said boxlike cross-sectional profile having said opening for stiffening said frame.

2. The side wall according to claim 1, including screws for screwing said lid to said frame.

3. The side wall according to claim 1, wherein said lid and said frame engage with one another in a form-locking manner.

4. The side wall according to claim 1, wherein said frame has a bottom portion, and including members selected from the group thereof consisting of supports, ribs, and struts connecting said kinking portion of said frame to said bottom portion of said frame, said members being additionally built into said boxlike cross-sectional profile for increasing rigidity of the side wall.

5. The side wall according to claim 1, wherein said side wall body is of one-piece construction, and including a removable plate mounted in said upper structural region, wherein bearings for rollers of an inking unit and bearings for cylinders of an printing unit are received, for stiffening said side wall body on said one side of said boxlike cross-sectional profile having said opening, said removable plate serving to transmit axial forces of the roller bearings to said side wall body.

6. The side wall according to claim 1, wherein said lid is formed of steel or cast iron.

7. The side wall according to claim 1, wherein said frame has a side and said at least one recess is open at said side for facilitating assembly of the gear wheels.

8. The side wall according to claim 1, wherein said frame of the side wall of a respective printing unit is constructed integrally with respect to said upper structural region of said side wall body wherein bearings of the rollers of an inking unit are received, and with respect to said lower structural region of said side wall body wherein bearings of printing unit cylinders are received.

9. The side wall according to claim 4, wherein said supports extend at both sides around bearings of shafts connecting the gear wheels and the printing cylinders.

* * * * *